United States Patent [19]

Miska et al.

[11] 4,288,483

[45] Sep. 8, 1981

[54] WEATHERSTRIP WITH HEAT SEALED SUBSTRATE

[75] Inventors: Stanley R. Miska, Rochester; Jay E. Boyce, Honeoye Falls, both of N.Y.

[73] Assignee: Schlegel Corporation, Rochester, N.Y.

[21] Appl. No.: 185,663

[22] Filed: Sep. 9, 1980

[51] Int. Cl.[3] ..... D04H 11/00

[52] U.S. Cl. ..... 428/92; 49/475; 49/489; 156/72; 428/95; 428/97; 428/259

[58] Field of Search ..... 428/92, 95, 97, 259, 428/88; 156/72, 272; 49/475, 489

[56] References Cited

U.S. PATENT DOCUMENTS

| | | | |
|---|---|---|---|
| 3,175,256 | 3/1965 | Horton | 49/489 |
| 3,266,190 | 8/1966 | Jackson | 49/489 |
| 3,404,487 | 10/1968 | Johnson | 156/72 |

*Primary Examiner*—Marion McCamish

*Attorney, Agent, or Firm*—Cushman, Darby & Cushman

[57] ABSTRACT

Weatherstrip is composed of a substrate having a pile strip upstanding from one surface thereof. In one embodiment the substrate is made of two different materials, one of which is a thermoplastic material that is heat sealed by being passed over a heated bar to prevent the edges of the weatherstrip from fraying. The other material maintains the structural integrity of the substrate during heat-sealing. Essentially the whole of the undersurface of the substrate including the portion immediately beneath the pile strip contains the aforementioned thermoplastic material, making it possible for the substrate to be surface mounted on a component such as a door or window fabricated of a material compatible to the thermoplastic material. In another embodiment the substrate may be composed entirely or partly of the thermoplastic material, and the same thermoplastic material is extruded onto the back of the substrate.

22 Claims, 11 Drawing Figures

FIG. 1
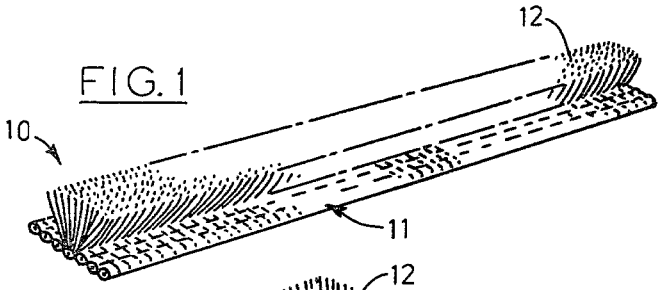
FIG. 2
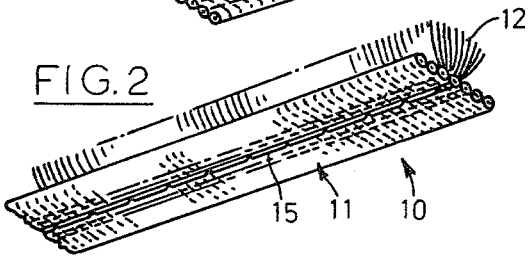
FIG. 7
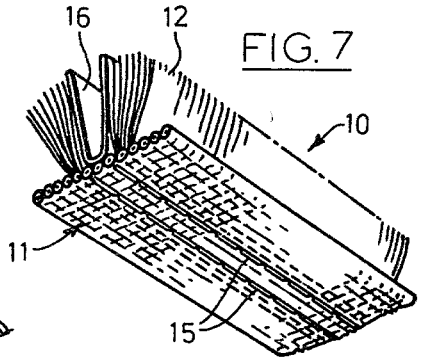
FIG. 3a
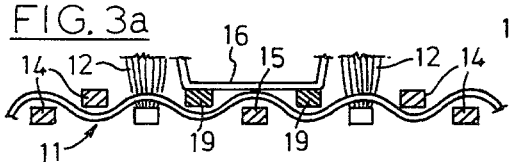
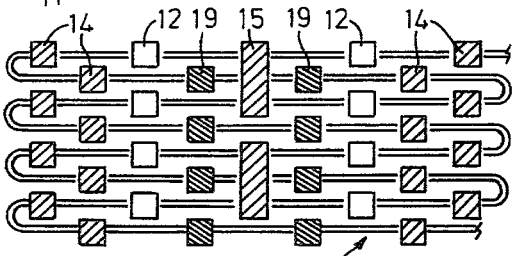
FIG. 3b
LEGEND
POLYPROPYLENE YARN
VINYL YARN
PILE YARN
FIG. 4a
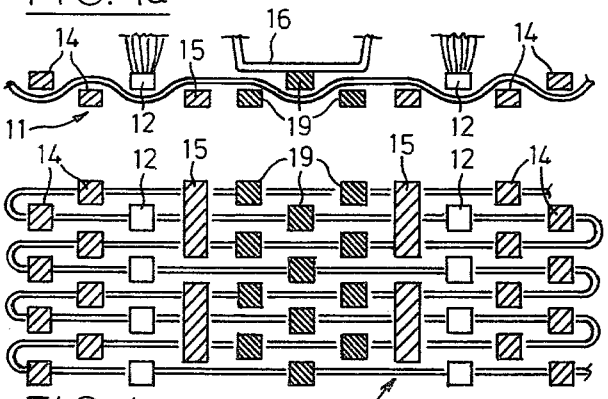
FIG. 4b FIG. 5a
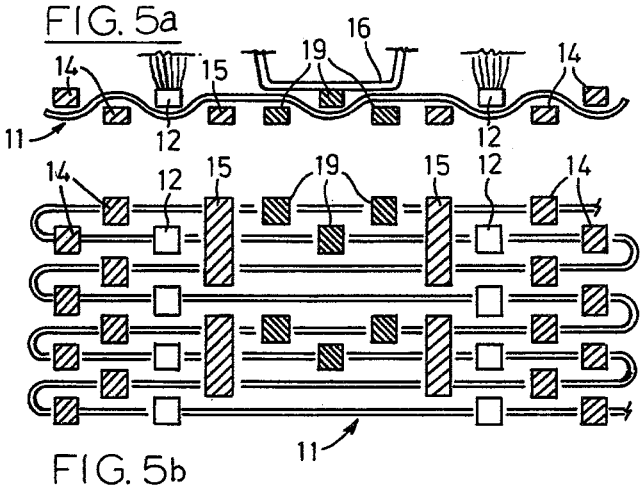
FIG. 5b
POLYPROPYLENE YARN
VINYL YARN
PILE YARN
FIG. 6a
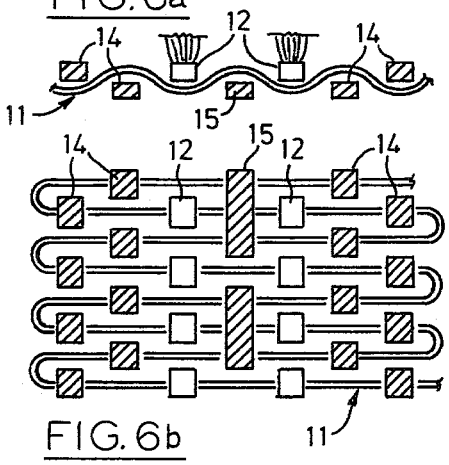
FIG. 6b

WEATHERSTRIP WITH HEAT SEALED SUBSTRATE

This invention relates to flexible weatherstrip and methods for making flexible weatherstrip. The weatherstrip may be used as a perimeter seal, for example, and is particularly suitable for doors and windows, although its uses are not limited thereto.

For a number of years weatherstrip sold under the trade mark Fin-Seal has been commercially available. This type of weatherstrip and methods for making it are described in U.S. Pat. No. 3,175,256, R. C. Horton, issued Mar. 30, 1965, the disclosure of which is incorporated herein by reference.

In the manufacture of Fin-Seal weatherstrip a backing or substrate, which may be formed from polypropylene yarns, for example, is woven in a loom. During the weaving operation a plurality of spaced apart, parallel, pile strips also are woven into the backing and are arranged to project upwardly therefrom. Typically the pile is formed by yarns such as filament polypropylene yarns that have been siliconed and ultraviolet stabilized.

Following the weaving operation a suitable plastic material, e.g., polypropylene, is extruded onto the back of the substrate, i.e., the face of the substrate opposite to that from which the pile strips project. This step secures the pile in place, since the pile yarns are woven through the substrate and appear on the back surface thereof, increases the rigidity of the substrate and permits the substrate to be slit between the pile strips without fraying.

After the extrusion step the substrate is slit between the pile strips to form individual lengths of weatherstrip each consisting of a backing or substrate and a single pile strip upstanding therefrom.

Finally a barrier strip of impervious, flexible, heet material, which may be polypropylene, for example, is positioned within the pile strip running the length thereof and is secured to the substrate, e.g., by heat sealing.

Instead of fabricating the flexible backing or substrate of the weatherstrip of woven strands of polypropylene, it can be fabricated of woven strands of either a thermoplastic material and a thermosetting material; two thermoplastic materials that have different melting points; or a thermoplastic material and some other material having a higher melting point. The pile strips, which are composed of resilient fibers, can be woven into the substrate in the same way as previously described, i.e., during the weaving of the substrate on a loom. However, instead of then having to extrude a suitable plastic material onto the back of the substrate, heat simply is applied to the back of the substrate to an extent sufficient to cause the thermoplastic material to melt. This seals the substrate by bonding the strands together, secures the pile strips in place and prevents fraying of the substrate when it subsequently is slit.

If the thermoplastic material is selected to be compatible with the material of the window, door, etc. to which the weatherstrip is to be secured, the weatherstrip can be surface mounted, as contrasted with the more expensive form of mounting commonly used involving provision of an extrusion with a T-slot therein to receive the backing of the weatherstrip. Surface mounting can be achieved by heat sealing or by using an adhesive compatible with the backing and the surface on which it is to be mounted. Where the thermoplastic is vinyl, for example, and the surface on which the weatherstrip is to be mounted also is vinyl, a suitable solvent or chemical can be used to render the vinyl tacky and capable of being adhered in a vinyl-to-vinyl seal, or the vinyl can be heat sealed. As is well known, it is difficult to bond polypropylene to a mounting surface, which is why extrusions with T-slots have been used with weatherstrips having polypropylene backing.

The material of the substrate that does not melt provides the necessary structural integrity for the substrate when melting of the other material takes place to ensure that the substrate does not fall apart and that the pile strips remain in place.

While it will be readily apparent to those skilled in the art that a wide variety of materials can be used for the substrate, particularly satisfactory results have been achieved with vinyl coated polyester yarns. Strictly by way of example, and not by way of limitation, other materials that may be used in the substrate are vinyl, polypropylene, polyester, nylon, rayon and cotton, but it must be remembered that in this embodiment of the invention a thermoplastic material must be present together with some other material that will maintain the structural integrity of the substrate when heat sufficient to melt the substrate is applied thereto.

Strictly by way of example, and not by way of limitation, entirely satisfactory results have been achieved using vinyl coated polyester yarns 3000 denier after coating (1000/192 uncoated) in the warp and 675 denier after coating (150/30 uncoated) in the weft. In this particular example the pile strips were composed of 1050/84/0.52 gray polypropylene, siliconed and ultraviolet stabilized. Heat sealing was accomplished by passing the substrate over a brass rod heating to a temperature between 440° F. and 460° F. at a speed of 3.1 feet per minute.

It will be appreciated that if two thermoplastic materials having different melting points are employed for the substrate, there must be a sufficiently large difference in their melting points that the required structural integrity is preserved during melting of the lower melting point material.

Any suitable material can be employed for the pile. The fibers of the pile should be resilient and durable however. Polypropylene is a preferred material.

Following the heat sealing operation, the substrate is slit in a conventional manner, and as previously described.

The final step may be placement of a barrier strip of impervious, flexible, sheet material lengthwise within or immediately beside the pile and the securing of the strip to the substrate. This can be achieved by a heat sealing operation in a now known manner (see the aforementioned U.S. Patent). In order to facilitate the heat sealing operation, the substrate in the region of the pile is made of the same material as the barrier strip, and this material is heat sealable, thereby making it possible to heat seal the barrier strip to the substrate. This makes it possible for the material of the barrier strip to be different from either or both of the materials from which the part of the substrate other than the aforesaid region is made, so that the different properties of the various materials in their different applications can be utilized.

Whether or not a barrier strip is employed, the fact that the pile strips are woven into the substrate creates an area or region on the lower surface of the substrate that is not compatible with the surface on which the substrate is to be mounted. For example, where the thermoplastic is vinyl, the surface on which the substrate is to be mounted is vinyl and the fibers of the pile strips are polypropylene, the polypropylene fibers will not heat seal to the vinyl mounting surface, reducing the efficiency of the bond between the weatherstrip and mounting surface. Where a barrier strip is employed, the problem is even more severe since, as noted above, the substrate in the region of the pile is made of the same material as the barrier strip, e.g., polypropylene, so an even larger region that will not bond to the mounting surface is provided.

The foregoing problem is solved, in accordance with the instant invention, by insuring that the thermoplastic material is located beneath the region of the substrate made of the same material as the barrier strip, and by ensuring that the thermoplastic material also is located beneath the region where the pile strips are woven into the substrate, so that the whole undersurface of the substrate is of thermoplastic material compatible with the material of the mounting surface.

In accordance with one aspect of this invention there is provided a flexible material for use as weatherstripping comprising a flexible substrate of woven strands of material; a pile strip of resilient fibers upstanding from said substrate, secured thereto and extending longitudinally of said substrate; and a barrier strip of impervious, flexible sheet material located within or immediately beside said pile strip, secured to said substrate and also extending longitudinally of said substrate; said strands of said substrate being composed of at least first and second different polymeric materials and a structural integrity maintaining material; said first polymeric material being a heat sealable material, being the same material as that of said barrier strip, being located in a region adjacent to said pile strip and extending longitudinally of said substrate to provide a region in said substrate to which said barrier strip is heat sealed; said second polymeric material and said structural integrity maintaining material being located laterally on either side of said region and at least one strand of said second polymeric material also being located on the side of said region remote from said barrier strip such that said first polymeric material is essentially located between said barrier strip and said at least one strand of said second polymeric material; said second polymeric material being a thermoplastic material distributed throughout said substrate in such a way that when said thermoplastic material is melted and then solidified, said strands of material become bonded together so that said substrate can be cut without fraying of the resulting edge, said thermoplastic material located laterally on either side of said region also being located at least on the side of said substrate opposite from the side from which said fibers upstand and thereby providing with said at least one strand of said second polymeric material a surface which can be heat sealed to compatible material; said structural integrity maintaining material being distributed throughout the thermoplastic material in such a way that when said thermoplastic material is melted, said structural integrity maintaining material preserves the structural integrity of said substrate.

In accordance with another aspect of this invention there is provided a flexible material for use as weatherstripping comprising a flexible substrate of woven strands of material; a pile strip of resilient fibers upstanding from said substrate, secured thereto and extending longitudinally of said substrate; said strands of said substrate being composed of a thermoplastic material and a structural integrity maintaining material, said thermoplastic material being distributed throughout said substrate in such a way that when said thermoplastic material is melted and then solidified, said strands of material become bonded together so that said substrate can be cut without fraying of the resulting edge; and at least one strand of said thermoplastic material located on the side of said substrate opposite to the side from which said fibers upstand and immediately adjacent to the region of said substrate containing said pile strip, said at least one strand being located at a level lower than the level of said pile strip; said thermoplastic material also being located at least on the side of said substrate opposite to the side from which said fibers upstand and together with said at least one strand providing a surface which can be heat sealed to compatible material; said structural integrity maintaining material being distributed throughout said thermoplastic material in such a way that when said thermoplastic material is melted, said structural integrity maintaining material preserves the structural integrity of said substrate.

The embodiment of the invention previously discussed avoids the necessity of an extrusion step where a plastic material is extruded onto the back of the substrate. However, this invention also is applicable to weatherstripping made with the inclusion of such a step. In this case, instead of employing a heated bar over which the substrate is passed to melt the thermoplastic material, the same thermoplastic material as is employed in the substrate is extruded over the lower surface of the substrate. In this embodiment it is not necessary for the substrate to include structural integrity maintaining material, although it could, and it may be composed entirely of the thermoplastic material. For example, the substrate may be woven entirely of vinyl yarns, except for the region of the substrate to which the barrier strip is to be heat sealed, and vinyl extruded onto the back of the substrate. In this embodiment of the invention what is required is that there be sufficient thermoplastic material, e.g., vinyl, at the lower surface of the substrate that the vinyl extruded onto the back of the substrate can bond to it. The extruded vinyl serves to prevent fraying of the substrate when it is cut and also provides a surface that can be heat sealed to a vinyl window to surface mount the weatherstrip. On the other hand, with this embodiment mounting in a T-slot also is possible.

In accordance with another aspect of this invention there is provided a flexible material for use as weatherstripping comprising a flexible substrate of woven strands of material; a pile strip of resilient fibers upstanding from said substrate, secured thereto and extending longitudinally of said substrate; and at least one strand of a thermoplastic material located on the side of said substrate opposite to the side from which said fibers upstand and immediately adjacent to the region of said substrate containing said pile strip, said at least one strand being located at a level lower than the level of said pile strip; at least the lower surface of said substrate opposite to the surface thereof from which said fibers upstand and on either side of said region being composed at least in part of said thermoplastic material, said thermoplastic material being different than the material from which said pile strip is fabricated.

In accordance with another aspect of this invention there is provided a flexible material for use as weatherstripping comprising a flexible substrate of woven strands of material, a pile strip of resilient fibers upstanding from said substrate, secured thereto and extending longitudinally of said substrate; a barrier strip of impervious, flexible sheet material located within or immediately beside said pile strip, secured to said substrate and also extending longitudinally of said substrate; said substrate including a heat sealable material of the same material as said barrier strip located in a region adjacent to said pile strip and extending longitudinally of said substrate to provide a region in said substrate to which said barrier strip is heat sealed; and at least one strand of a thermoplastic material located on the side of said region remote from said barrier strip and at a level lower than the level of said pile strip and said heat sealable material, at least the lower surface of said substrate opposite to the surface thereof from which said fibers upstand and on either side of said region being composed at least in part of said thermoplastic material, said thermoplastic material being different than the material from which said pile strip is fabricated and different from the material from which said barrier strip is fabricated.

This invention will become more apparent from the following detailed description, taken in conjunction with the appended drawings, in which:

FIG. 1 is a perspective view from the top of weatherstrip embodying this invention;

FIG. 2 is a perspective view from the bottom of weatherstrip embodying this invention;

FIG. 3*b* is a bottom view of weatherstrip embodying the instant invention, while FIG. 3*a* is a transverse cross section through the weatherstrip of FIG. 3*b*.

FIG. 4*a* and 4*b*, 5*a* and 5*b* and 6*a* and 6*b* are views similar to FIGS. 3*a* and 3*b* but of three other embodiments of the invention.

FIG. 7 is a perspective view from the bottom of weatherstrip embodying the instant invention incorporating a barrier strip and of the type which is shown in FIGS. 4*a* and 4*b*.

Referring to FIG. 1, the weatherstrip 10 shown therein consists of a flexible substrate 11 of woven yarns or strands of material and a pile strip 12 of resilient fibers woven into substrate 11, upstanding therefrom, secured thereto and extending longitudinally of substrate 11.

In this embodiment the strands of substrate 11 are composed of a thermoplastic material and a structural integrity maintaining material with the thermoplastic material being distributed throughout substrate 11 in such a way that when the thermoplastic material is melted and then solidified, the strands of material become bonded together, so that substrate 11 can be cut without fraying of the resulting edge. In this respect, it should be understood that when making weatherstrip 10 of the type shown in FIG. 1, it is normal for substrate 11 to be considerably wider than is shown in FIG. 1 and for more than one pile strip to be employed, the individual weatherstrip of the type shown in FIG. 1 being formed by slitting of the substrate between adjacent pile strips.

Preferably, as hereinbefore indicated, the strands of the substrate are vinyl coated polyester yarns, the vinyl being the thermoplastic material and the polyester being the structural integrity maintaining material. Also, as previously indicated hereinbefore, preferably pile strip 12 is fabricated of polypropylene, but it is to be clearly understood that materials other than these preferable materials may be employed without departing from the instant invention in its broadest aspect.

It also is to be understood that in forming the weatherstrip 10 shown in FIG. 1, substrate 11 may be passed over a heated bar (not shown) which melts the thermoplastic material in the substrate bonding the strands thereof together so that, as previously indicated, the substrate can be cut without fraying of the resulting edge.

Pile strip 12, being woven into substrate 11, results in two rows on the lower surface of substrate 11 that are composed of polypropylene fibers, as shown in FIG. 6*b*. In contrast, the regions 14 (FIG. 6*b*) to the outside of the two pile rows comprise vinyl coated polyester yarn, so that the lower surface of substrate 11 in regions 14 is a vinyl surface that can be heat-sealed to a vinyl window frame, or the like.

In accordance with the instant invention, the region where the pile rows are located is modified so that it also can be heat sealed to the vinyl window frame or the like notwithstanding the presence of the polypropylene fibers of pile strip 12. This is achieved by the provision of a vinyl coated polyester yarn 15 woven into substrate 11 in the region of pile strip 12 in such a way that it will heat seal to the vinyl window frame or the like in the same way and at the same time as regions 14 are heat sealed to the window frame. In the embodiment of the invention shown in FIGS. 6*a* and 6*b*, yarn 15 is woven into substrate 11 in such a way that only every fourth fill yarn loops under yarn 15, so that a substantial part of yarn 15 is exposed on the bottom surface of substrate 11. This is perhaps most clearly shown in FIGS. 2 and 6*b*. The result is that yarn 15, except in the region of every fourth fill yarn, is below the level of the pile loops that are exposed on the bottom surface of substrate 11.

In the embodiment of the invention shown in FIGS. 3*a*, 3*b*, 4*a*, 4*b*, 5*a*, 5*b* and 7 a barrier strip 16 that preferably is a polypropylene, but which may be formed of other materials, is employed. While the barrier strip is shown as being of generally U-shaped configuration, it may assume other forms, of course. The barrier strip may be within or immediately to one side of pile strip 12.

In order to facilitate the securing of barrier strip 16 to substrate 11 by heat sealing, it is important that the barrier strip and the part of substrate 11 to which it is to be secured be of the same heat-sealable material. Thus, where barrier strip 16 is made of polypropylene, it is desirable for the region of substrate 11 that is directly below barrier strip 16 to include polypropylene to which barrier strip 16 can be heat sealed readily, while the regions to the outside of pile strip 12 comprise vinyl coated polyester yarns, for example. This is achieved, in the embodiment of the invention illustrated in the aforementioned figures, by making strands 19 of polypropylene. In the embodiment shown in FIGS. 3*a* and 3*b* there are two strands 19 of polypropylene woven with respect to the fill yarns on a one up, one down basis. In the embodiment shown in FIGS. 4*a* and 4*b* there are three strands 19 also woven with respect to the fill yarns on a one up, one down basis. In the embodiment of FIGS. 5*a* and 5*b* there are three stands 19 of polypropylene woven with respect to the fill yarns on a three up, one down basis, thereby maximizing the amount of polypropylene at the upper surface of substrate 11 in the region of barrier strip 16 and minimizing the amount of polypropylene in that same region that appears at the lower surface of substrate 11.

The polypropylene strands 19 create the same problem at the lower surface of substrate 11 as is created by pile strip 12, namely the presence of polypropylene which cannot bond to a vinyl window or the like. In the embodiment of the invention shown in FIGS. 3*a* and 3*b*, this problem is solved in the same way as it is solved in connection with the embodiment of FIGS. 6*a* and 6*b*, namely by the inclusion of a strand 15 of a vinyl coated polyester yarn woven in the same way into substrate 11 as strand 15 in FIGS. 6*a* and 6*b* but located between polypropylene strands 19. Thus, strand 15 in FIGS. 3*a* and 3*b* is woven on a three down, one up basis with respect to the fill yarns and provides a substantial amount of vinyl at a level below the level of polypropylene strands 19, thereby enhancing the capability of the weatherstrip shown in FIGS. 3*a* and 3*b* to be heat sealed to a vinyl window frame or the like.

In the embodiment of the invention shown in FIGS. 4*a* and 4*b* there are two strands 15 of vinyl coated polyester yarn located between polypropylene strands 19 and inside pile strip 12. In this embodiment of the invention strands 15 facilitate bonding in an area which otherwise would be constituted by polypropylene pile loops as well as polypropylene strands 19. This also is true of the embodiment of the invention shown in FIGS. 5*a* and 5*b* where two strands 15 woven on a three down, one up basis are employed.

In effect, in the embodiments of the invention shown in FIGS. 3*a*, 3*b*, 4*a*, 4*b*, 5*a*, 5*b* and 7 the upper surface of substrate 11 in the region of barrier strip 16 is constituted in part by polypropylene, making it possible to heat seal barrier strip 16 to substrate 11, while the lower surface of substrate 11 in the region immediately beneath barrier strip 16 is provided with vinyl material so that it as well as the parts of the substrate outside of pile strip 12 can be heat sealed to a vinyl window frame or the like.

It will be appreciated from the foregoing that in the embodiments of the invention hereinbefore described in detail, substrate 11 is formed from at least two different polymeric material and at least one other material, which also may be polymeric, and which provides the required and structural integrity when substrate 11 is heated, either in the formation of the weatherstrip or when being heat sealed to a vinyl window frame or the like. One of the first-mentioned polymeric materials is used for strands 19, is heat sealable and is of the same material as barrier strip 16. The other of the first-mentioned polymeric materials is different from that used for strands 19, is thermoplastic and is the material which melts during the aforementioned heat sealing operations. This does not necessarily mean that three different materials are used in substrate 11, since the same material may be used for strands 19 as is used to maintain the structural integrity of the substrate during heat sealing provided that this also is the same material which is used for barrier strip 16.

The thermoplastic material and the structural integrity maintaining material are located laterally on either side of the region where the polypropylene barrier strip and or pile strip is located and are distributed throughout each other in such a way that when the thermoplastic material is melted and then solidified, the strands of the substrate become bonded together, so that substrate 11 can be cut without fraying of the resulting edge, and the structural integrity maintaining material preserves the structural integrity of substrate 11 while the thermoplastic material is in its soft or melted condition. For example, where vinyl is used as the thermoplastic material and polyester as the structural integrity maintaining material, polyester may be used in the fill and both vinyl and polyester in the warp. Of course the fill yarns will pass through the region where the polypropylene is located, but this will not adversely affect the heat sealable characteristics thereof or prevent barrier strip 16 from being heat sealed to substrate 11.

It should be clear from the foregoing that the thermoplastic material is located at least on the lower side of substrate 11, i.e., the side opposite to that from which the fibers of pile strip 12 upstand, and over essentially the whole of that lower side, to provide a surface which can be heat sealed to compatible material, making surface mounting of the weatherstrip possible, as contrasted with the more expensive form of mounting commonly used involving provision of an extrusion with a T-slot therein to receive the backing. Surface mounting can be achieved by heat sealing or by using an adhesive compatible with the backing and the surface on which it is to be mounted. Where the thermoplastic material of the substrate is vinyl, and where the aforementioned surface also happens to be vinyl, a suitable solvent or chemical can be used to render the vinyl tacky and capable of being adhered in a vinyl-to-vinyl seal.

While it is preferred that pile strip 12 be woven into substrate 11, if desired, pile strip 12 may be secured to substrate 11 by a flocking technique.

The embodiments of the invention previously discussed avoid the necessity of an extrusion step where a plastic material is extruded onto the back of the substrate. However, this invention also is applicable to weatherstripping made with the inclusion of such a step. In this case, instead of employing a heated bar to mount the thermoplastic material, the same thermoplastic material as is employed in the substrate is extruded over the lower surface of the substrate. In this case it is not necessary for the substrate to include structural integrity maintaining material, although it could, and it may be composed entirely of the thermoplastic material. For example, the substrate may be woven entirely of vinyl yarns (except for strands 19) and vinyl extruded onto the back of the substrate. In this embodiment of the invention, which is applicable to all of the different designs shown in FIGS. 3 through 6 inclusive, what is required is that there be sufficient thermoplastic material, e.g., vinyl at the lower surface of the substrate that the vinyl extruded onto the back of the substrate can bond to it. In this case strand or strands 15 function so as to assist the bonding of the extruded material to the substrate in the region where there is polypropylene. The extruded vinyl serves to prevent fraying of the substrate when it is cut and also provides a surface that can be heat sealed to a vinyl window to surface mount the weatherstrip. On the other hand, with this embodiment mounting in a T-slot also is possible.

While preferred embodiments of this invention have been described in detail, those skilled in the art will appreciate that changes and modifications may be made thereto without departing from the spirit and scope of the invention as defined in the appended claims.

We claim:

1. A flexible material for use as weatherstripping comprising a flexible substrate of woven strands of material; a pile strip of resilient fibers upstanding from said substrate, secured thereto and extending longitudinally of said substrate; and a barrier strip of impervious, flexible sheet material located within or immediately beside said pile strip, secured to said substrate and also extending longitudinally of said substrate; said strands of said substrate being composed of at least first and second different polymeric materials and a structural integrity maintaining material; said first polymeric material being a heat sealable material, being the same material as that of said barrier strip, being located in a region adjacent to said pile strip and extending longitudinally of said substrate to provide a region in said substrate to which said barrier strip is heat sealed; said second polymeric material and said structural integrity maintaining material being located laterally on either side of said region and at least one strand of said second polymeric material also being located on the side of said region remote from said barrier strip such that said first polymeric material is essentially located between said barrier strip and said at least one strand of said second polymeric material; said second polymeric material being a thermoplastic material distributed throughout said substrate in such a way that when said thermoplastic material is melted and then solidified, said strands of material become bonded together so that said substrate can be cut without fraying of the resulting edge, said thermoplastic material located laterally on either side of said region also being located at least on the side of said substrate opposite from the side from which said fibers upstand and thereby providing with said at least one strand of said second polymeric material a surface which can be heat sealed to compatible material; said structural integrity maintaining material being distributed throughout said thermoplastic material in such a way that when said thermoplastic material is melted, said structural integrity maintaining material preserves the structural integrity of said substrate.

2. The flexible material of claim 1 wherein said first polymeric material and the material of said barrier strip is polypropylene.

3. The flexible material of claim 1 wherein said first polymeric material and the material of said barrier strip is polypropylene, and wherein said thermoplastic material is vinyl and said structural integrity maintaining material is polyester.

4. The flexible material of claim 1 wherein said first polymeric material and the material of said barrier strip is polypropylene and wherein said thermoplastic material is vinyl and said structural integrity maintaining material is polyester, said vinyl being a coating on said polyester.

5. A flexible material for use as weatherstripping comprising a flexible substrate of woven strands of material; a pile strip of resilient fibers upstanding from said substrate secured thereto and extending longitudinally of said substrate; said strands of said substrate being composed of a thermoplastic material and a structural integrity maintaining material, said thermoplastic material being distributed throughout said substrate in such a way that when said thermoplastic material is melted and then solidified, said strands of material become bonded together so that said substrate can be cut without fraying of the resulting edge; and at least one strand of said thermoplastic material located on the side of said substrate opposite to the side from which said fibers upstand and immediately adjacent to the region of said substrate containing said pile strip, said at least one strand being located at a level lower than the level of said pile strip; said thermoplastic material also being located at least on the side of said substrate opposite to the side from which said fibers upstand and together with said at least one strand providing a surface which can be heat sealed to compatible material; said structural integrity maintaining material being distributed throughout said thermoplastic material in such a way that when said thermoplastic material is melted, said structural integrity maintaining material preserves the structural integrity of said substrate.

6. The flexible material of claim 1 or claim 5 wherein said thermoplastic material is vinyl and said structural integrity maintaining material is polyester.

7. The flexible material of claim 1 or claim 5 wherein said thermoplastic material is vinyl and said structural integrity maintaining material is polyester, said vinyl being a coating on said polyester.

8. The flexible material of claim 1 or claim 5 wherein said thermoplastic material is vinyl said structural integrity maintaining material is polyester and said pile is polypropylene.

9. A flexible material for use in weatherstripping comprising a flexible substrate of woven strands of material; a pile strip of resilient fibers upstanding from said substrate, secured thereto and extending longitudinally of said substrate; and at least one strand of a thermoplastic material located on the side of said substrate opposite to the side from which said fibers upstand and immediately adjacent to the region of said substrate containing said pile strip, said at least one strand being located at a level lower than the level of said pile strip; at least the lower surface of said substrate opposite to the surface thereof from which said fibers upstand and on either side of said region being composed at least in part of said thermoplastic material, said thermoplastic material being different than the material from which said pile strip is fabricated.

10. A flexible material according to claim 9 wherein said thermoplastic material is vinyl.

11. A flexible material according to claim 10 wherein said pile strip is polypropylene.

12. A flexible material according to claim 9 including a strip of said thermoplastic material extruded onto said lower surface and adhered thereto.

13. A flexible material according to claim 12 wherein said thermoplastic material is vinyl.

14. A flexible material according to claim 13 wherein said pile strip is polypropylene.

15. A flexible material for use as weatherstripping comprising a flexible substrate of woven strands of material; a pile strip of resilient fibers upstanding from said substrate, secured thereto and also extending longitudinally of said substrate; a barrier strip of impervious, flexible sheet material located within or immediately beside said pile strip, secured to said substrate and also extending longitudinally of said substrate; said substrate including a heat sealable material of the same material as said barrier strip located in a region adjacent to said pile strip and extending longitudinally of said substrate to provide a region in said substrate to which said barrier strip is heat sealed; and at least one strand of a thermoplastic material located on the side of said region remote from said barrier strip and at a level lower than the level of said pile strip and said heat sealable material, at least the lower surface of said substrate opposite to the surface thereof from which said fibers upstand and on either side of said region being composed at least in part of said thermoplastic material, said thermoplastic material being different than the material from which said pile strip is fabricated and different from the material from which said barrier strip is fabricated.

16. A flexible material according to claim 15 wherein said thermoplastic material is vinyl.

17. A flexible material according to claim 16 wherein said pile strip is polypropylene.

18. A flexible material according to claim 17 wherein said barrier strip is polypropylene.

19. A flexible material according to claim 15 including a strip of said thermoplastic material extruded onto said lower surface and adhered thereto.

20. A flexible material according to claim 19 wherein said thermoplastic material is vinyl.

21. A flexible material according to claim 20 wherein said pile strip is polypropylene.

22. A flexible material according to claim 21 wherein said barrier strip is polypropylene.

* * * * *